United States Patent [19]

Hashimoto

[11] 4,122,659

[45] Oct. 31, 1978

[54] DIGITAL CLOCK OF LEAF TYPE

[75] Inventor: Katuo Hashimoto, Iida, Japan

[73] Assignee: Iida Sankyo Kabushiki Kaisha, Japan

[21] Appl. No.: 742,890

[22] Filed: Nov. 18, 1976

[30] Foreign Application Priority Data

Nov. 20, 1975 [JP] Japan ..... 50/157515

[51] Int. Cl.[2] ..... G04B 13/00; G04B 19/02; G04B 19/20

[52] U.S. Cl. ..... 58/7; 58/125 C

[58] Field of Search ..... 58/2, 23 D, 125 C, 147, 58/7, 16 D, 125 R, 126 E

[56] References Cited

U.S. PATENT DOCUMENTS

| | | | |
|---|---|---|---|
| 3,738,570 | 6/1973 | Vogt | 58/125 R X |
| 3,830,053 | 8/1974 | Koide et al. | 58/125 C |
| 3,973,339 | 8/1976 | Ueda | 58/125 C X |
| 4,005,570 | 2/1977 | Miyamoto et al. | 58/125 C X |
| 4,027,469 | 6/1977 | Yaguinuma | 58/125 C X |

*Primary Examiner*—Stanley J. Witkowski
*Attorney, Agent, or Firm*—McGlew and Tuttle

[57] ABSTRACT

A rotary transmission between a "minute" display mechanism and an "hour" display mechanism is disclosed for use in a digital clock of leaf type. The transmission is disposed between a first bobbin supporting minute's display members and a second bobbin supporting "hour's" display members. The first bobbin carries a planetary gear, which meshes with a ring gear as well as a driven gear formed on the second bobbin. The ring gear has a number of teeth which is different from the number of teeth on the driven gear.

10 Claims, 2 Drawing Figures

DIGITAL CLOCK OF LEAF TYPE

BACKGROUND OF THE INVENTION

Generally, a digital clock of leaf type comprises a first bobbin supporting sixty leaf-like display members each carrying a numeral from "00" to "59", and a second bobbin supporting twenty-four leak-like display members each carrying a numeral from "1" to "24". The first and the second bobbin are mounted on a common shaft, journaled for rotation on a frame, so as to be rotatable relative to each other, and the first bobbin is driven to rotate at a rate of one revolution per hour by a motor having a uniform speed. The rotation of the first bobbin is transmitted through a suitable speed reduction transmission to the second bobbin so that the second bobbin rotates 1/24 revolution per that of the first bobbin. As the first bobbin rotates, the minute's display members carried thereon also rotate presenting a different minute's display member for view for each minute. A shift of the hour display members takes place in synchronism with the change of the minute's display from "59" to "00".

A conventional rotary transmission used in the usual digital clocks of the type mentioned above to provide a coupling between the both bobbins comprises an intermediate shaft disposed laterally of the time display mechanism in parallel relationship with the main shaft. The intermediate shaft carries a speed reduction gear which is loosely fitted thereon and which meshes with a gear substantially integral with the first bobbin and another gear substantially integral with the second bobbin. The provision of an increased number of gears result in a troublesome assembly operation. The location of the rotary transmission toward one end of the clock is unfavorable to the design of the clock. Finally, the location of the minute's display and the hour's display close to each other is undesirable in providing a clearly visible indication of the time.

SUMMARY OF THE INVENTION

It is an object of the invention to provide a digital clock of leaf type having a rotary transmission which is located intermediate a "minute's" display mechanism and an "hour's" display mechanism to provide an increased separation therebetween for facilitating a clear reading of the time indication.

It is another object of the invention to provide a digital clock of leaf type incorporating a rotary transmission having a reduced number of gears, thereby facilitating the assembly.

Other objects, features and advantages of the invention will become apparent from the following description.

DETAILED DESCRIPTION OF EMBODIMENT

Figure 1:
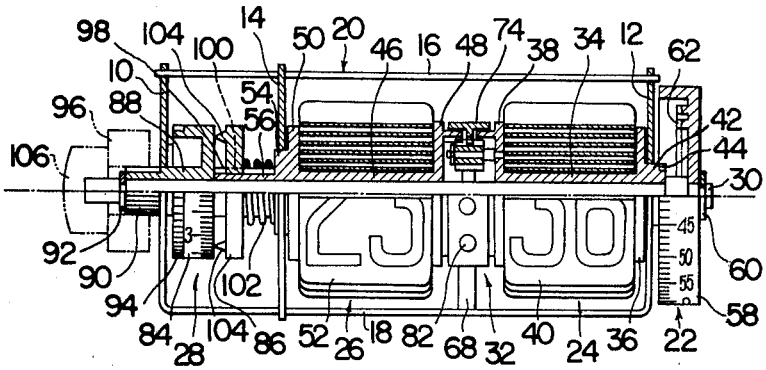
FIG. 1 is a front view, partially in longitudinal section, of one embodiment of the invention.

Referring to FIG. 1, there is shown a digital clock of leaf type which is constructed in accordance with one embodiment of the invention. As shown, the clock essentially comprises a frame or housing 20 including a pair of opposite sidewalls 10, 12, an intermediate partition wall 14, and a top plate 16 as well as a bottom plate 18 which connect these walls; a "second's" display mechanism 22; a "minute's" display mechanism 24; an "hour's" display mechanism 26; a timer assembly 28; a main shaft 30 which supports the various display mechanisms 22, 24 and 26 as well as the time assembly 28; and a rotary transmission 32 which transmits rotation of the "minute's" display mechanism 24 to the "hour's" display mechanism 26.

As in a conventional digital clock of leaf type, the "minute's" display mechanism 24 includes a first bobbin 34 having a pair of opposite flanges 36, 38. Sixty leaf-like "minute's" display members 40 have their one end pivotally supported around the bobbin 34 intermediate the both flanges so as to be rockable. The bobbin 34 has an axial bore which is tightly fitted on the main shaft 30 for integral rotation. On its right-hand side, the bobbin 34 is formed with a cylindrical extension 42 which is concentric with its axial bore, the extension 42 freely extending through an opening formed in the sidewall 12. A gear 44 is formed around the periphery of the cylindrical extension 42 at a position externally of the sidewall 12. On its front surface, each of the 60 minute display members 40 carries the lower half of a sequential number from "00" to "59" while the rear surface of each display member 40 carries the upper half of a numeral, the lower half of which is indicated on the front surface of an immediately preceding display member 40, thereby enabling a single numeral to be displayed by a pair of display members 40. A detent pawl, not shown, extends downwardly from a suitable stationary member located above the display members 40, for example, from the top plate 16, to engage the free end of each minute display member 40, so that the upper half of the numeral which is indicated on the rear surface of the engaged minute display member can be viewed in combination with the lower half of the same numeral indicated on the front surface of its immediately preceding minute display member, which assumes a downwardly depending position by virtue of its own gravity, thereby indicating a single numeral. As the bobbin 34 rotates, the detent pawl is disengaged from the particular minute display member 40 which has been engaged therewith, thereby allowing a sequential shift of one minute display member per minute.

The "hour's" display mechanism 26 includes of second bobbin 46 having a pair of opposite flanges 48, 50. Forty-eight leaf-like hour display members 52 have their one end rockably mounted around the periphery of the bobbin 46. The bobbin 46 has an axial bore through which the main shaft 30 extends freely. On its left-hand side, the bobbin 46 is formed with a cylindrical extension 54 which is concentric with its axial bore, the extension 54 freely extending through an opening formed in the intermediate partition wall 14. Another cylindrical extension 56 of a reduced diameter projects axially from the outer surface of the cylindrical extension 54. The lower half of a sequential numeral from "1" to "24" is indicated on the front surface of the forty-eight hour display member 52. However, in this instance, two consecutive hour display members 52 carry the lower half of the same numeral, so that it may be combined with the upper half of the same numeral indicated on the rear surface of an immediately following hour display member 52 to present a perfect indication of a single numeral. Again a detent pawl, not shown, which depends from a stationary part located above the hour display members 52, for example, from the top plate 16, engages the free end of the hour display members 52 so that the upper half of a particular numeral which is presented on the rear surface of a particular hour display member held by the detent pawl may be combined with the lower half of the same numeral presented on the front surface of an immediately preceding hour display member, which assumes a downwardly depending position by virtue of its own gravity, thereby fully indicating a single numeral. The bobbin 46 is adapted to rotate through one revolution per 24 hours, by means of the transmission to be described later. As the bobbin 46 rotates, the detent pawl mentioned above is disengaged from a particular hour display member 52 and engages a succeeding hour display member 52 once per thirty minutes. Since the same numeral is indicated on two consecutive hour display members 52, the display of hours changes as two consecutive hour display members 52 are released or disengaged from the detent pawl, or for each hour.

Rotation is transmitted to the "minute's" display mechanism 24 from the "second's" display mechanism 22, which includes a "second" display drum 58. The drum 58 is loosely fitted on the main shaft 30 at a position externally of the sidewall 12, and is locked against withdrawal by a locking pin 60. The outer periphery of the second display drum 58 carries a scale of second's display having 60 graduations, which may be read by alignment with an index (not shown) provided on the marginal edge of the display window, not shown. The drum 58 is driven for rotation at a rate of one revolution per minute, by a motor having a uniform rate (not shown). The rotation of the drum 58 is transmitted to the first bobbin 34 through a train of speed reduction gears, not shown, which are interposed between a crown gear 62 formed on the inner surface of the drum 58 and the gear 44, thereby allowing the bobbin 34 to be driven for rotation at a rate of one revolution per hour.

Figure 2:
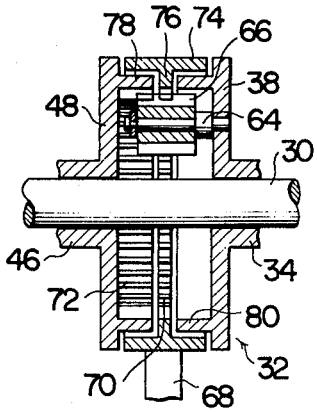
FIG. 2 is an enlarged longitudinal section of the rotary transmission shown in FIG. 1.

The rotary transmission 32 imparts the rotation of the "minute's" display mechanism 24 to the "hour's" display mechanism 26. As is best shown in FIG. 2. the rotary transmission comprises a planetary gear 66, a ring gear 70 and a driven gear 72. The planetary gear 66 is loosely fitted on a shaft 64 which is fixedly mounted on the flange 38 of the first bobbin 34 and outwardly extending therefrom. The ring gear 70 is formed as an internally toothed gear formed on the inner rib 76 of a ring 74 which is fixedly connected by a limb 68 with the bottom plate 18, and normally meshes with the planetary gear 66. The driven gear 72 is formed as an internally toothed gear on a ring 78 which is provided as an outward extension from the flange 48 of the second bobbin 46, and normally meshes with the planetary gear 66. The ring gear 70 has twenty-three teeth while the driven gear 72 has twenty-four teeth. As a consequence, when the planetary gear 66 has rotated through one revolution along the ring gear 70 and the driven gear 72 as a result of one revolution of the first bobbin 34, the driven gear 72 undergoes a rotation through 1/24 revolution. The internal structure of the rotary transmission 32 is shielded from sight to prevent the appearance of the clock from being impaired, by locating the ring 78 inside the ring 74 with a suitable clearance therebetween and providing a shield ring 80 on the flange 38 of the first bobbin 34 which is radially outwardly spaced from the planetary gear and which is located inside the ring 74 with a suitable clearance therebetween. The stationay ring 74 is provided with a "colon" mark 82 to provide a clear separation or demarcation between the minute's and the hour's indications, as shown in FIG. 1.

As shown in FIG. 1, the timer assembly 28 is disposed intermediate the sidewall 10 and the intermediate partition wall 14, and carries a registration display wheel 84 and a registration cam wheel 86. The registration display wheel 84 has an axial bore which permits it to be loosely fitted on the main shaft 30. On its left-hand side, the registration display wheel 84 is formed with a cylindrical extension 88 which is concentric with its axial bore, with the extension 88 loosely extending through an opening formed in the sidewall 10. A portion of the cylindrical extension 88 which extends externally of the sidewall 10 is provided with a knurling 90 on which a time setting knob 96 is fitted. A locking ring 92 is fitted on the main shaft 30 toward its left-hand end, in abutment against the end face of the cylindrical projection 88, thereby assuring against the withdrawal of the main shaft 30. Around its left-hand peripheral edge, the registration display wheel 84 is formed with a number of projections and recesses 94 in the form of a gear, for engagement by a click spring, not shown. As a consequence, the registration display wheel 84 rotates as the knob 96 is turned, but a free rotation of the wheel 84 is prevented by the engagement of the click spring with a particular one of the recesses 94 formed in the peripheral edge thereof when a turning of the knob 96 is stopped. The display wheel 84 is peripherally provided with a scale of time graduation to cover twenty-four hours, a particular one of the graduations being brought into alignment with an index (not shown) formed on the display window to permit a reading of a preset timing at which the timer operates. In its right-hand sidewall, the display wheel 84 is formed with a pair of cam slots which are at different radial distances from the axis thereof.

The registration cam wheel 86 is loosely fitted on the cylindrical extension 56 which integrally extends from the second bobbin 46, and is formed with a projection 100 extending from the axial bore thereof which engages an axial groove 98 formed in the cylindrical extension 56, whereby it is slidable in the axial direction but cannot rotate about the shaft. The registration cam wheel 86 is resiliently urged to the left by a coiled spring 102 which is interposed between the cam wheel 86 and the cylindrical extension 54 of the second bobbin. In the condition shown in FIG. 1, a pair of cam projections 104 formed on the left-hand sidewall of the registration cam wheel 86 bear against the right-hand sidewall of the registration display wheel 84, whereby a sliding movement of the wheel 86 under the resilience of the spring 102 is inhibited. The pair of cam projections 104 are located on the same radii as the radii of rotation of the cam slots formed in the registration display wheel 84. Thus, when the wheels 84 and 86 assume such relative position that the cam slots and the cam projections 104 are aligned with each other, the registration cam wheel 86 may be resiliently moved to the left, as viewed in FIG. 1. The resulting travel of the registration cam wheel 86 is utilized to operate a switch or a buzzer, not shown. It will be noted that a time adjusting knob 106 is secured to the left-hand end of the main shaft 30.

In operation the "second" display drum 58 is driven by a motor, not shown, to rotate at a rate of one revolution per minute. The rotation of the drum 58 is transmitted through the train of speed reduction gears, not shown, to the gear 44, whereby the first bobbin 34 is driven for rotation at a rate of one revolution per hour. For each 1/60 revolution of the bobbin 34 or for each minute, one of the leaf-like minute display members 40 which are carried by the bobbin 34 freely falls down to present their front side, whereby a numeral representing the minute's unit of the time is indicated by a combination of the lower half of the numeral presented on the front surface of the particular display member which has just assumed the lower position and the upper half of the same numeral presented on the rear surface of its immediately following display member. As the bobbin 34 rotates through one revolution, the rotary transmission 32 is effective to cause a 1/24 revolution of the second bobbin 46. As mentioned previously, one of the hour display members 52 mounted on the bobbin 46 falls down to present its front side for each 1/48 revolution of the bobbin 46 for every 30 minutes. However, since two consecutive hour display members 52 carry the upper half and lower half of the same numeral on their rear and front surfaces, respectively, a shift of hours's display takes place as 2 hour display members fall down in synchronism with a change of the minute's display from "59" to "00" as presented by the minute display members 40.

When the time display which is exhibited by the "minute's" and "hour's" display mechanism does not coincide with the true time, the knob 106 may be manually gripped to turn the main shaft 30, which is integral therewith, and the first bobbin 34 in the same direction of rotation as is effected by the motor. When the coincidence is reached, a turning of the knob 106 may be stopped.

When it is desired to operate the timer assembly, the knob 96 is manually gripped to turn the registration display wheel 84 integral therewith until a desired graduation of the scale carried thereon is aligned with the corresponding index, whereupon a turning of the knob 96 is stopped, thus leaving the display wheel 84 stationary. The registration cam wheel 86 rotates integrally with the second bobbin 46, and when the cam projections 104 on the registration cam wheel 86 move into alignment with the cam slots in the registration display wheel 84, the registration cam wheel 86 becomes free to move axially under the resilience of the spring 102 as a result of the engagement between the cam projections 104 and their associated cam slots. The resulting stroke of the registration cam wheel is utilized to operate a switch or a buzzer. The timer operation terminates after a given period of time when the registration cam wheel 86 rotates to move the cam projections 104 out of the cam slots in the display wheel 84 to cause an axial movement of the cam wheel 86 back to its original position, against the resilience of the spring 102.

While the invention has been described in some detail in terms of a preferred embodiment thereof, it should be understood that the combination of parts, arrangement and configuration can be modified in various forms without departing from the spirit and scope of the invention defined by the appended claims.

What is claimed is:

1. A digital clock of leaf type comprising a "minute's" display mechanism including a first continuously rotatable bobbin for supporting a plurality of leaf-like display members, and "hour's" display mechanism including a second continuously rotatable bobbin for supporting a plurality of leaf-like hour display members and a rotary transmission for transmitting rotation of said "minute's" display mechanism to said "hour's" display mechanism, said "minute's" and said "hour's" display mechanism, and said rotary transmission comprising a planetary gear rotatably mounted to said first bobbin adjacent said second bobbin, a fixed ring gear disposed between said first and second bobbins and in meshing engagement with said planetary gear for rotating said planetary gear as said first bobbin rotates, and a driven gear connected to said second bobbin in meshing engagement with said planetary gear rotatable by said planetary gear as said first bobbin rotates.

2. A digital clock of leaf type according to claim 1 in which the ring gear has a number of teeth which is different from the number of teeth on the driven gear.

3. A digital clock of leaf type according to claim 1 in which the both ring gear and the driven gear are formed as internally toothed gears.

4. A digital clock of leaf type according to claim 3 in which the ring gear is provided on its outer surface with a mark which provides a demarcation between the "minute's" and the "hour's" display.

5. A digital clock of leaf type according to claim 1, in which all of the "minute's" and the "hour's" display mechanism and the rotary transmission are disposed in a coaxial relationship.

6. A digital clock of the leaf type comprising a housing having opposed side walls, a main shaft extending between said side walls, a minute display member having a first bobbin with a plurality of leaf-like displays pivotally connected thereto fixed to said shaft to rotate therewith, an hour display member having a second bobbin with a plurality of leaf-like displays pivotally connected thereto mounted on said shaft, said second bobbin of said hour display member being rotatably mounted on said shaft so as to rotate independently of said shaft, a means for effecting the rotation of said shaft and said first bobbin of said minute display member fixed to said shaft, and a transmission means interposed between said first and second bobbins whereby said second bobbin of said hour display member is rotatably driven by the rotation of said first bobbin of said minute display member, said transmission means including a planetary gear rotatably connected to said first bobbin, said planetary gear being disposed between said first and second bobbins, a fixed ring gear, said planetary gear being disposed in meshing relationship with said ring gear, and a driven gear fixed to said second bobbin, said driven ring gear being disposed in meshing relationship with said planetary gear, said fixed ring gear having a diameter substantially equal to that of said driven ring gear and the number of teeth of said gears being different whereby said second bobbin rotates with respect to said fixed gear by the rotation of said planetary gear.

7. The invention as defined in claim 6, wherein said minute display bobbin is rotated one revolution per hour.

8. The invention as defined in claim 7, wherein said hour display bobbin rotates 1/24 of a revolution per that of said minute bobbin.

9. The invention as defined in claim 6, and including a timer assembly mounted on said shaft.

10. The invention as defined in claim 9, wherein said timing assembly includes a registration display wheel loosely mounted on said shaft, a cam wheel slidably mounted for movement toward and away from said registration wheel, said registration wheel and cam wheel having interlocking means.

* * * * *